US008138662B2

(12) United States Patent
Kotowicz

(10) Patent No.: US 8,138,662 B2
(45) Date of Patent: Mar. 20, 2012

(54) ELECTRODE FOR A DISCHARGE LAMP

(75) Inventor: Adam Kotowicz, Berlin (DE)

(73) Assignee: Osram AG, München (DE)

( * ) Notice: Subject to any disclaimer, the term of this patent is extended or adjusted under 35 U.S.C. 154(b) by 215 days.

(21) Appl. No.: 12/520,087

(22) PCT Filed: Dec. 18, 2006

(86) PCT No.: PCT/EP2006/069840

§ 371 (c)(1),
(2), (4) Date: Jun. 18, 2009

(87) PCT Pub. No.: WO2008/074361

PCT Pub. Date: Jun. 26, 2008

(65) Prior Publication Data

US 2010/0039035 A1 Feb. 18, 2010

(51) Int. Cl.
*H01J 19/06* (2006.01)

(52) U.S. Cl. ..... 313/346 R; 313/240

(58) Field of Classification Search ..... 313/122, 313/125, 141, 346 R, 240, 335
See application file for complete search history.

(56) References Cited

U.S. PATENT DOCUMENTS

| | | | | |
|---|---|---|---|---|
| 3,054,014 | A | 9/1962 | Johannes | |
| 3,244,929 | A | 4/1966 | Bernhard | |
| 3,911,309 | A * | 10/1975 | Kummel et al. | 313/346 R |

FOREIGN PATENT DOCUMENTS

| | | |
|---|---|---|
| EP | 1 560 255 | 8/2005 |
| EP | 1 439 567 | 7/2007 |
| GB | 1 176 333 | 1/1970 |
| WO | WO 03/075311 | 9/2003 |

* cited by examiner

*Primary Examiner* — Bumsuk Won
(74) *Attorney, Agent, or Firm* — Cozen O'Connor

(57) ABSTRACT

An electrode for a discharge lamp (I) with a core (11) and a sheath (12), which surrounds at least regions of the core (11). The sheath (12) has, in the longitudinal direction (A), a continuous bore (121), which has a first diameter (d1) in a first subregion and a second diameter (d2) in a second subregion.

9 Claims, 3 Drawing Sheets

ELECTRODE FOR A DISCHARGE LAMP

RELATED APPLICATIONS

This is a U.S. national stage of application No. PCT/EP2006/069840, filed on Dec. 18, 2006.

FIELD OF THE INVENTION

The invention relates to an electrode, in particular a cathode, for a discharge lamp with a core and a sheath, which surrounds at least regions of the core.

BACKGROUND OF THE INVENTION

The cathodes of DC high-pressure discharge lamps, such as HBO lamps (mercury vapor lamps) or XBO lamps (xenon lamps), for example, generally consist of tungsten, which has been doped with thorium oxide. The proportion of thorium oxide is in this case approximately 0.4 to approximately 3% by weight. Since thorium oxide is a radioactive substance, radioactivity can also be found in thoriated tungsten electrodes. Legislative regulations control the handling of radioactive substances. If a critical activity is reached, different identification requirements and measures are necessary when handling these substances. Doping cathodes with thorium oxide has the function of lowering the work function at the cathode peak, as a result of which a lower cathode peak temperature can be achieved during lamp operation. Associated with this, the cathode burnback is reduced over the lamp life, which becomes apparent to the user in a positive way in a lower decrease in the utilized flux or the utilized radiated light.

An increase in the lamp power generally requires an enlargement of the cathode dimensions in order to keep the temperature and the electrode burnback associated therewith as low as possible. In the case of discharge lamps with a power of up to approximately 5 kW, the entire cathode or the cathode head can be produced from thoriated material without the limit value of the activity being exceeded. At powers of more than 8 kW, this is no longer possible.

In particular in the case of cathodes which comprise a core and a sheath, these cathodes have not proven to be mechanically stable when they have a conventional configuration. In particular during lamp starting, it may arise that the cathode is torn apart.

SUMMARY OF THE INVENTION

One object of the present invention is to provide an electrode for a discharge lamp which is mechanically stable and in which the core and the sheath can be arranged in stable fashion with respect to one another.

An electrode according to an aspect of the invention is in particular in the form of a cathode. The electrode for a discharge lamp comprises a core and a sheath, which surrounds at least regions of the core. As a result, two subregions of different materials are formed. The sheath has, in the longitudinal direction, a continuous bore, which has a first diameter in a first subregion and a second diameter in a second subregion. This can improve the mechanically stable fastening of components in the sheath.

Preferably, the transition of the bore from the first diameter to the second diameter has a stepped design. As a result of such a discrete transition, the mechanical fixing and stable positioning can be improved.

Preferably, the bore in the sheath has a smaller diameter at the end facing the discharge space of the discharge lamp than at the end remote from the discharge space.

Preferably, the core extends over the entire length of the bore in the subregion of the first diameter. In particular, regions of the core also extend in the subregion of the second diameter. As a result, the fastening of the core in the sheath can be improved.

Preferably, the core comprises a base, which is arranged in the sheath and has a larger diameter than the smaller of the two diameters of the bore. In particular, the base is present at the transition between the two diameters of the bore and extends into the subregion of the bore with the larger diameter. This configuration makes it possible to ensure virtual anchoring of the core in the sheath. This can prevent the core from being ripped out of the sheath, in particular during lamp starting.

The sheath is preferably formed from a material which is free of thorium. The problem of the permissible radioactivity limits being exceeded can thus be prevented.

Preferably, the core is formed from a thorium-doped material. As a result, two different material regions are provided in the electrode, with the core in particular being formed coaxially with respect to the longitudinal axis of the electrode and therefore also with respect to the longitudinal axis of the sheath.

Preferably, an electrode holder extends into the subregion of the bore with the larger diameter.

The core and the electrode holder are formed so as to bear against one another in the sections extending into the sheath. The core therefore preferably rests with its base on the electrode holder.

The electrode holder can be soldered to the sheath. The core can also be soldered to or compressed with the sheath. In particular, corresponding solder material can be introduced between the sheath and the core. Furthermore, however, compression can also be provided. For this purpose, a metal foil can be formed between the core and the sheath. The solder material or the metal foil ensures the electrical and thermal contact between the two parts of the electrode.

In addition to the mechanical stability of the electrode and of the individual components, in particular the core, the sheath and the electrode holder, virtually any desired reduction in radioactivity of a cathode can be achieved. Furthermore, the use of different materials such as molybdenum, for example, for the sheath is possible. However, the sheath can also be formed from tungsten,
for example. A mixture of different materials for the sheath can also be provided. The core is preferably formed from tungsten and doped with thorium.

The use of different materials for the sheath can increase the resistance to breakage of the entire electrode system and reduce the weight thereof. This can also facilitate processing of the component part, for example boring or the production of a surface structure.

Furthermore, owing to the multicomponent configuration of the electrode with a core and a sheath, a modular construction kit principle can be realized. It is therefore possible for different electrodes, in particular cathodes, to be formed very easily with an identical sheath geometry and different cores, which vary in terms of the material composition, the geometry of the peaks or the like, for example.

Furthermore, the separation of the electrode into a core and a sheath makes it possible to realize a relatively small thoriated region which can be compressed more easily. Furthermore, easier high-temperature cleaning annealing can therefore also take place.

Another aspect of the invention relates to a high-pressure discharge lamp with an electrode according to an embodiment of the invention or an advantageous configuration thereof. In particular, the high-pressure discharge lamp can be in the form of a mercury vapor lamp or in the form of a xenon lamp.

Preferably, the high-pressure discharge lamp is designed in such a way that it has an electrical power of greater than or equal to 4 kW, in particular greater than or equal to 5 kW. The proposed electrode has proven to be particularly advantageous for high-pressure discharge lamps which even have electrical powers of greater than 8 kW. Owing to the configuration of the electrode, the limit values of the activity can be adhered to, and the mechanical stability of the individual components of the electrode can be ensured, even in the case of discharge lamps with such powers.

In the case of a configuration as a mercury vapor lamp, the mercury concentration can preferably be greater than or equal to 8 mg/ccm, in particular greater than or equal to 10 mg/ccm. If the discharge lamp is in the form of a xenon lamp, a xenon coldfilling pressure is preferably greater than 6 bar, in particular greater than 8 bar.

BRIEF DESCRIPTION OF THE DRAWINGS

An exemplary embodiment of the invention will be explained in more detail below with reference to schematic drawings, in which.

DETAILED DESCRIPTION OF THE DRAWINGS

Figure 1:
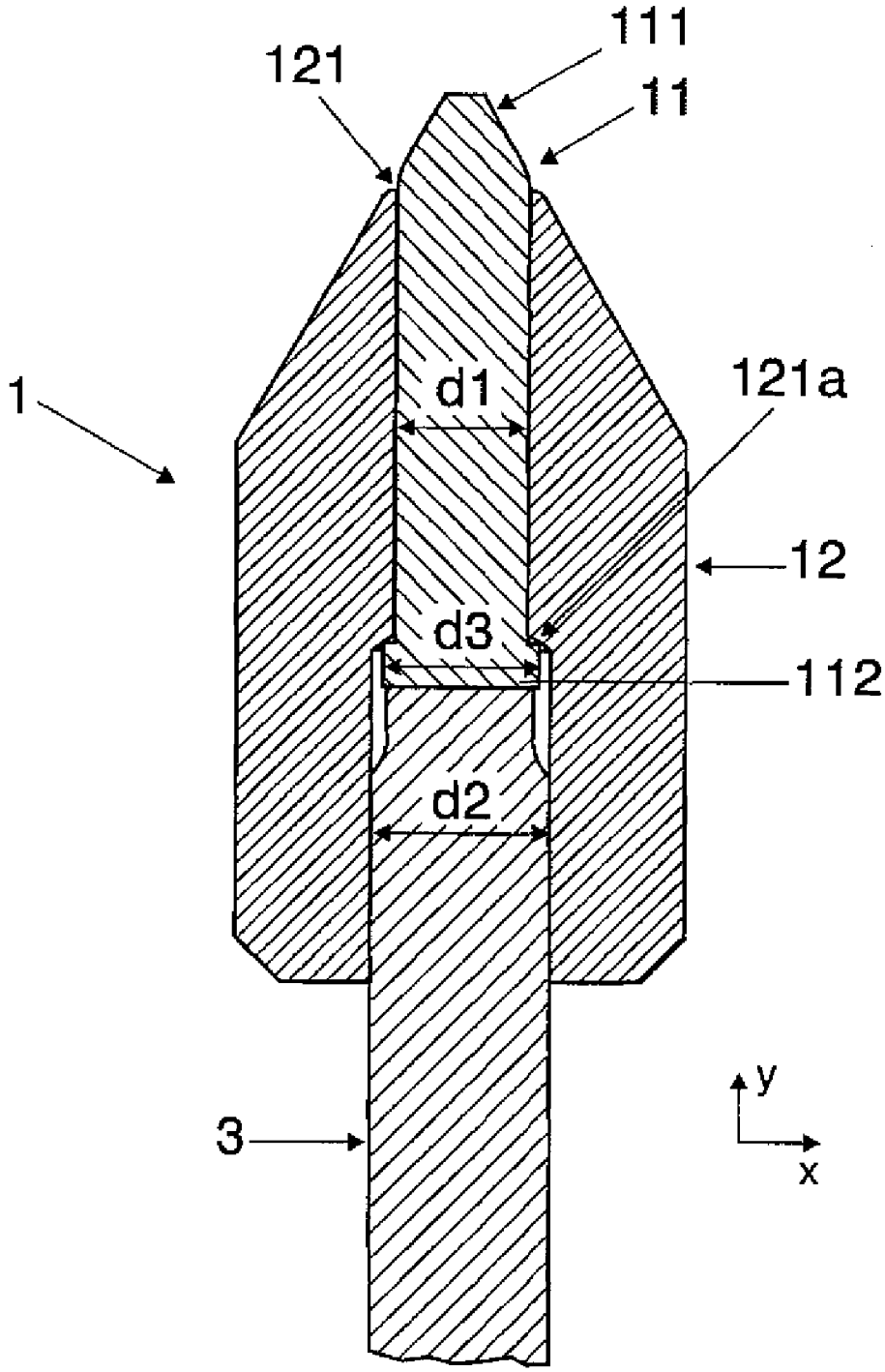
FIG. 1 shows a sectional illustration of an electrode according to an embodiment of the invention.

FIG. 1 shows a schematic sectional illustration through a cathode 1. The cathode 1 comprises a core 11, which in the exemplary embodiment is formed from a tungsten material, which has been doped with thorium.

The rod-shaped core 11 is surrounded by a sheath 12, which is formed from a material which is free from thorium, for example tungsten or molybdenum. In particular at the front end facing the discharge space of a discharge lamp, namely the peak of the cathode 1, the core 11 is arranged so as to protrude out of the sheath 12. A front end 111 of the core 11 is conical and extends out of the sheath 12.

The core 11 is arranged coaxially with respect to the longitudinal axis A (FIG. 2) of the sheath 12 and the cathode 1. Furthermore, the core 11 has a length (y direction) which is smaller than the sheath 12.

The sheath 12 has a bore 121 which is continuous in the longitudinal direction and which has a diameter d1 in a front subregion. In a rear subregion of the sheath 12, the bore 121 has a diameter d2 which is greater than the diameter d1.

A transition 121*a* of the bore 121 from the diameter d1 to the diameter d2 has a stepped design in the exemplary embodiment.

As can be seen from the illustration in FIG. 1, the core 11 extends over the entire length (y direction) of the subregion of the bore 121, which has the smaller diameter d1. At the rear end, the core 11 has a base 112, which has a diameter d3. In the exemplary embodiment, the diameter d3 is greater than the diameter d1 and smaller than the diameter d2 of the bore 121.

The core 11 is arranged in such a way that the base 112 extends into the subregion of the bore 121 with the greater diameter d2. The base 112 therefore acts as a stop of the core 11 at the transition 121*a*. Preferably, the base 112 is shaped in such a way that it bears with an accurate fit against the wall of the sheath 12 in the transition 121*a*.

Furthermore, an electrode holder 3 extends into the subregion of the bore 121 with the larger diameter d2, and the core 11, in particular the base 112, bears directly against the electrode holder 3.

The core 11 can be soldered into the sheath 12 or compressed with the sheath 12. For the case of soldering, a solder material can be introduced between the outer side of the core 11 and the inner side of the sheath 12 in the region of the bore 121. For the case of compression, a metal foil can be provided between the core 11 and the sheath 12. Correspondingly, it is possible for the electrode holder 3 to be soldered to or compressed with the sheath 12.

The sheath 12 therefore comprises a double bore, which is coaxial with respect to the longitudinal axis A, with different diameters d1 and d2.

Figure 2:
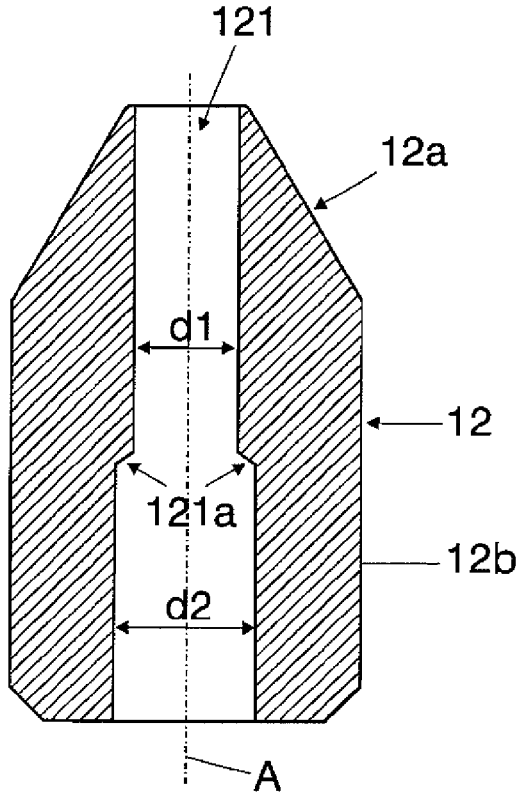
FIG. 2 shows a sectional illustration of a sheath of the electrode shown in FIG. 1.

FIG. 2 shows a sectional illustration of the sheath 12. The sheath 12 has a conical subregion 12*a* at its front end facing the discharge space. A cylindrical subregion 12*b* is formed so as to be adjacent to this conical subregion 12*a*.

The transition 121*a* is formed in the subregion 12*b*, when viewed in the direction of the longitudinal axis A. In the exemplary embodiment, the subregion of the bore 121 with the smaller diameter d1 has a longer length (y direction) than the subregion of the bore 121 with the larger diameter d2. It can furthermore be seen that the widening from the smaller diameter d1 to the larger diameter d2 is designed to be stepped in the transition 121*a*, with the step being formed by sloping walls of the sheath 12 which run downwards.

Figure 3:
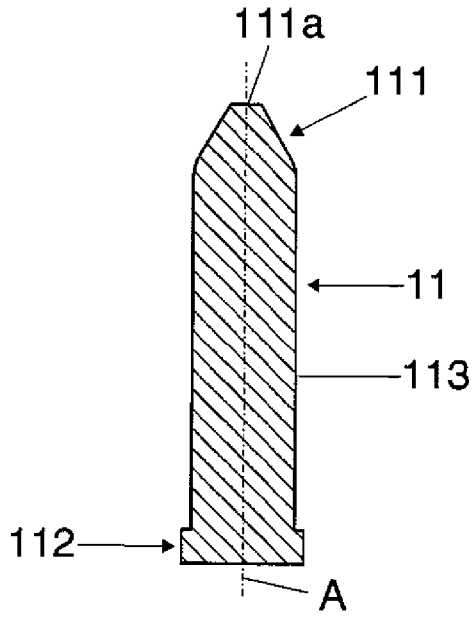
FIG. 3 shows a sectional illustration of a core of the electrode shown in FIG. 1.
Figure 4:
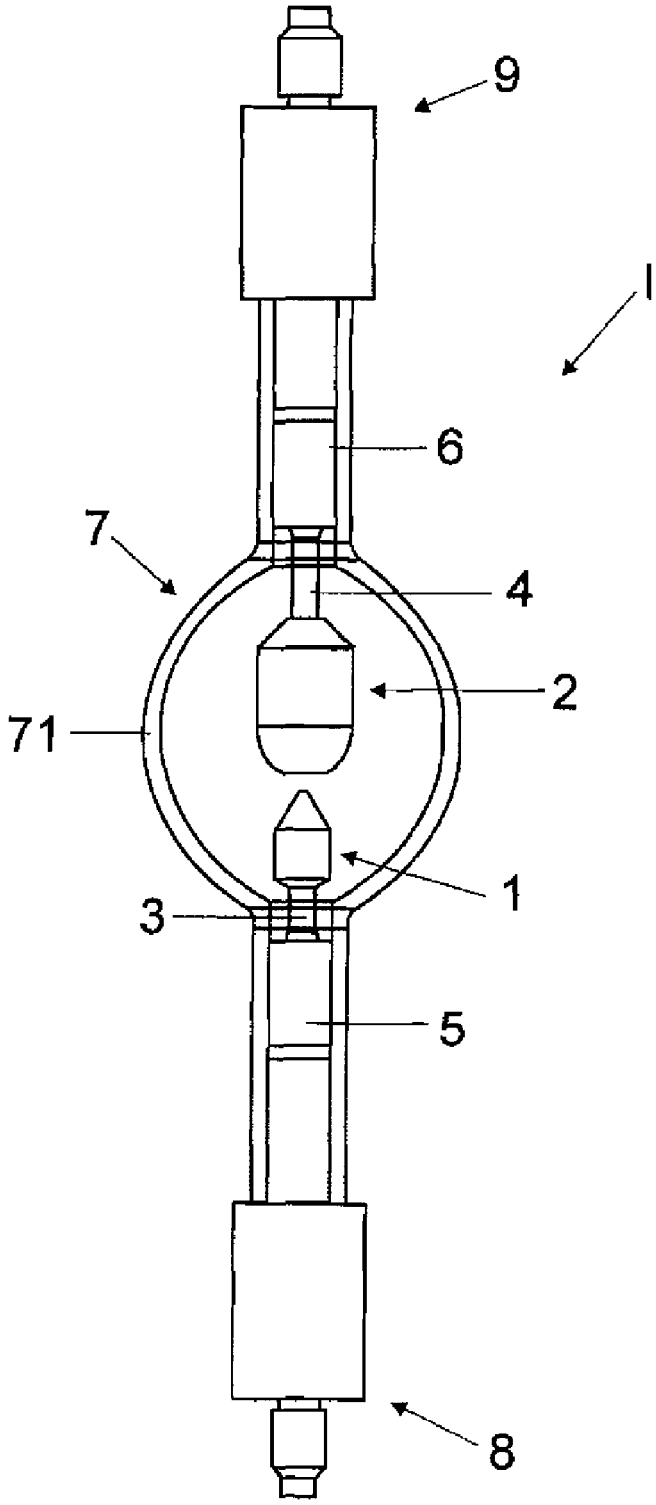
FIG. 4 shows a sectional illustration of a high-pressure discharge lamp according to an embodiment of the invention.

FIG. 3 shows a sectional illustration of the core 11, with the conical subregion being flattened off or designed to be flat at the front end 111. It can furthermore be seen that the transition from a central subregion 113 to the base 112 likewise has a stepped design.

FIG. 3 shows a schematic of a high-pressure discharge lamp I, which has a cathode 1 with the configuration shown in FIG. 1.

Furthermore, an anode 2 is formed, with the cathode 1 being fastened on the holding rod or the electrode holder 3 and the anode 2 being fastened on a holding rod or an electrode holder 4. These electrode holders 3 and 4, respectively, then each open out into further fastening elements 5 and 6, respectively, for example quartz bars. These mentioned components of the high pressure discharge lamp I are arranged in a discharge vessel 7 made from quartz glass, with in particular the anode 2 and the cathode 1 being arranged in an elliptical discharge bulb 71. The electrode holders 3 and 4 are connected to a molybdenum foil (not illustrated), which has been fused into the tubular ends of the discharge vessel 7 or the bulb necks, in a vacuum-tight manner. Furthermore, the high-pressure discharge lamp I comprises connection bases 8 and 9.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. An electrode for a discharge lamp with a core and a sheath, which surrounds at least regions of the core, wherein the sheath has, in the longitudinal direction, a continuous bore, which has a first diameter in a first subregion and a second diameter in a second subregion, wherein a transition of the bore from the first diameter to the second diameter has a stepped design, wherein the bore in the sheath has a smaller diameter at the end facing the discharge space than at the end remote from the discharge space, wherein the core comprises a base which is arranged in the sheath and has a larger diameter than the smaller of the first diameter and the second diameter, wherein the entire core is formed from a same thorium-doped material, and wherein an electrode holder extends into the subregion of the bore with the larger diameter.

2. The electrode as claimed in claim 1, wherein the core extends over the entire length of the bore in the subregion of the first diameter.

3. The electrode as claimed in claim 1, wherein the base is present at the transition between the two diameters of the bore and extends into the subregion of the bore with the larger diameter.

4. The electrode as claimed in claim 1, wherein the sheath is formed from a material which is free from thorium.

5. The electrode as claimed in claim 1, wherein the core rests on the electrode holder.

6. The electrode as claimed in claim 1, wherein the electrode holder is soldered to or compressed with the sheath.

7. The electrode as claimed in claim 1, wherein the core is soldered to or pressed with the sheath.

8. A high-pressure discharge lamp comprising an electrode as claimed in claim 1.

9. The electrode as claimed in claim 1, wherein the electrode holder is formed from a material which is free from thorium.

* * * * *